United States Patent [19]

McKinnon et al.

[11] 4,146,833

[45] Mar. 27, 1979

[54] SPARK ADVANCE TESTER

[75] Inventors: Donald C. McKinnon; Paul F. Bruce, both of Cheboygan, Mich.

[73] Assignee: Fox Valley Instrument Company, Cheboygan, Mich.

[21] Appl. No.: 870,981

[22] Filed: Jan. 20, 1978

[51] Int. Cl.[2] ..... F02P 17/00

[52] U.S. Cl. ..... 324/16 T

[58] Field of Search ..... 324/16 T, 15

[56] References Cited

U.S. PATENT DOCUMENTS

| | | | |
|---|---|---|---|
| 2,785,215 | 3/1957 | Yetter | 324/16 T |
| 3,597,677 | 8/1971 | MacCrea et al. | 324/16 T |
| 3,665,294 | 5/1972 | Pelta et al. | 324/16 T |
| 3,820,013 | 6/1974 | Gaudette, Jr. et al. | 324/16 T X |
| 4,008,430 | 2/1977 | Blum | 324/16 T X |
| 4,039,931 | 8/1977 | Schweizer | 324/16 T |
| 4,095,170 | 6/1978 | Schmitt | 324/16 T |

FOREIGN PATENT DOCUMENTS

| | | | |
|---|---|---|---|
| 1159473 | 7/1969 | United Kingdom | 324/16 T |

*Primary Examiner*—Stanley T. Krawczewicz

*Attorney, Agent, or Firm*—Price, Heneveld, Huizenga & Cooper

[57] ABSTRACT

This specification discloses a timing control circuit for a strobe lamp used in adjusting the ignition timing of an internal combustion engine. The control circuit includes an ignition firing detector with improved noise immunity, and a calibrated control for setting a strobe flash for a predetermined deviation from ignition firing. The output signal of the calibrated control is coupled to a first amplifier to determine the slope of a ramp voltage in part determining the flash point of the strobe lamp with respect to ignition firing. The output of the first amplifier is coupled to a second amplifier which generates a ramp voltage at the predetermined slope above a diode forward breakover voltage at the input to the second amplifier. The voltage drop across the diode, prevents false triggering by noise with a magnitude less than the diode voltage even when the maximum amplitude of the ramp voltage is near zero.

21 Claims, 3 Drawing Figures

SPARK ADVANCE TESTER

BACKGROUND OF THE INVENTION (1) Field of the invention.

This invention relates to engine ignition analyzers; and, in particular, to circuitry for processing signals generated by ignition firing for use in such equipment.

(2) Prior art.

A standard accessory for use with the conventional engine analyzer is a strobe or timing lamp which provides a pulsed light of very short duration. In a typical internal combustion, a fixed reference mark is provided on the engine housing adjacent the flywheel which carries another reference mark. When these two reference marks are aligned, the engine is in the top dead center position which normally corresponds to the firing time for the number 1 cylinder.

The conventional strobe lamp is triggered by the number 1 cylinder firing signal during running of the engine producing a repeating short light pulse permitting visual determination by the mechanic of the actual engine flywheel position with respect to the fixed reference mark for any engine speed. The mechanic notes the difference between the two reference marks, typically in degrees scribed next to the reference mark to determine the amount of advance of number 1 cylinder firing signal with respect to top dead center.

In improved timing lamps, a variable delay was introduced into the timing lamp so that the lamp trigger pulse was delayed with respect to the number 1 cylinder firing signal. In using this improved lamp, the mechanic adjusts the delay so that the two reference marks are aligned when the lamp is triggered, and reads the calibration of the delay adjustment in terms of degrees of advance.

Some qualities and features which characterize these improved lamps include:

(a) delay angle independent of RPM for a delay control setting.

(b) provision for angle setting and readout before or after operation on an engine.

(c) broadness of RPM range for accurate readings.

(d) spark ignition noise rejection preventing irregular delays and extraneous light pulses.

Problems commonly found in lamps however are: delays controlled for fixed time, not fixed duty cycle, and readout indicators such as meters that only indicate a control setting while the engine is running. Because readings are commonly taken at high engine RPM it is desirable to minimize the time to make measurements. If the lamp can be preset to the specified engine advance angle the time to visually locate the mark can be reduced and then the RPM can be immediately dropped since the reading will be held by the indicator.

Meters present some particular limitations on a timing lamp because of balance, parallax and motion which all add to the readout error. Sensitivity to mechanical shocks and magnet weight tend to limit durability and necessitate careful handling.

The environment of testing the ignition firing of an engine is very noisy and the problem of reducing the effects of electrical noise is difficult to solve. Further, the problem is significant because an accurate indication for the number of degrees of advance is increasingly important as automobile engines increase in complexity and pollution control equipment is added. There has been no satisfactory solution to the problem of providing a device having a commercially attractive price which is sufficiently noise resistant when readings of degrees of advance are made. Again, this is particularly true when the degrees of advance are relatively small or close to 0.

SUMMARY OF THE INVENTION

The invention includes a circuit for improving the accuracy of the reading of ignition advance when degrees of advance are very low and for improving the noise immunity of such readings. Noise immunity is provided by a spark detection circuit to inductively couple to a sparkplug wire and has a high impedence capacitive and resistive coupling means to amplify the received signal. The amplifier means has an output for triggering a logic circuit which generates a pulse output indicating the occurence of an ignition firing.

Noise immunity of the logic circuit is excellent because it is triggered by an amplified signal which is much larger in amplitude than typical noise signals. The consistency of readings indicating a relatively small degree of advance is improved by having a voltage greater than 0 represent 0 degrees of advance and having a ramp-like voltage start at a level above zero and act as part of the delaying action causing strobe firing after ignition firing. The starting level of the ramp voltage above 0 is the amount of voltage drop across a diode. As a result, when the ramp voltage needs to rise only to a very low level as with a very small degree of advance, a noise input equal to the amount of rise of the ramp voltage would not trigger it because it is less than the diode voltage at which the ramp rise started.

DETAILED DESCRIPTION OF THE INVENTION

On a 4-cycle engine, each sparkplug fires once every other crankshaft rotation. The advance angle is the number of degrees before top dead center (TDC) that the plug fires and is a proportion of the total time necessary to make one engine ignition cycle which includes two crankshaft rotations. The advance angle usually changes with engine revolutions (RPM), and may have to be checked at different rpm's as listed in the specification. The advance readings may be preset before engine rpm is adjusted and readings of the preferred embodiment of timing advance tester 10 described below are independent of the engine rpm's from about 500 to about 10,000 rpm's.

Figure 1:
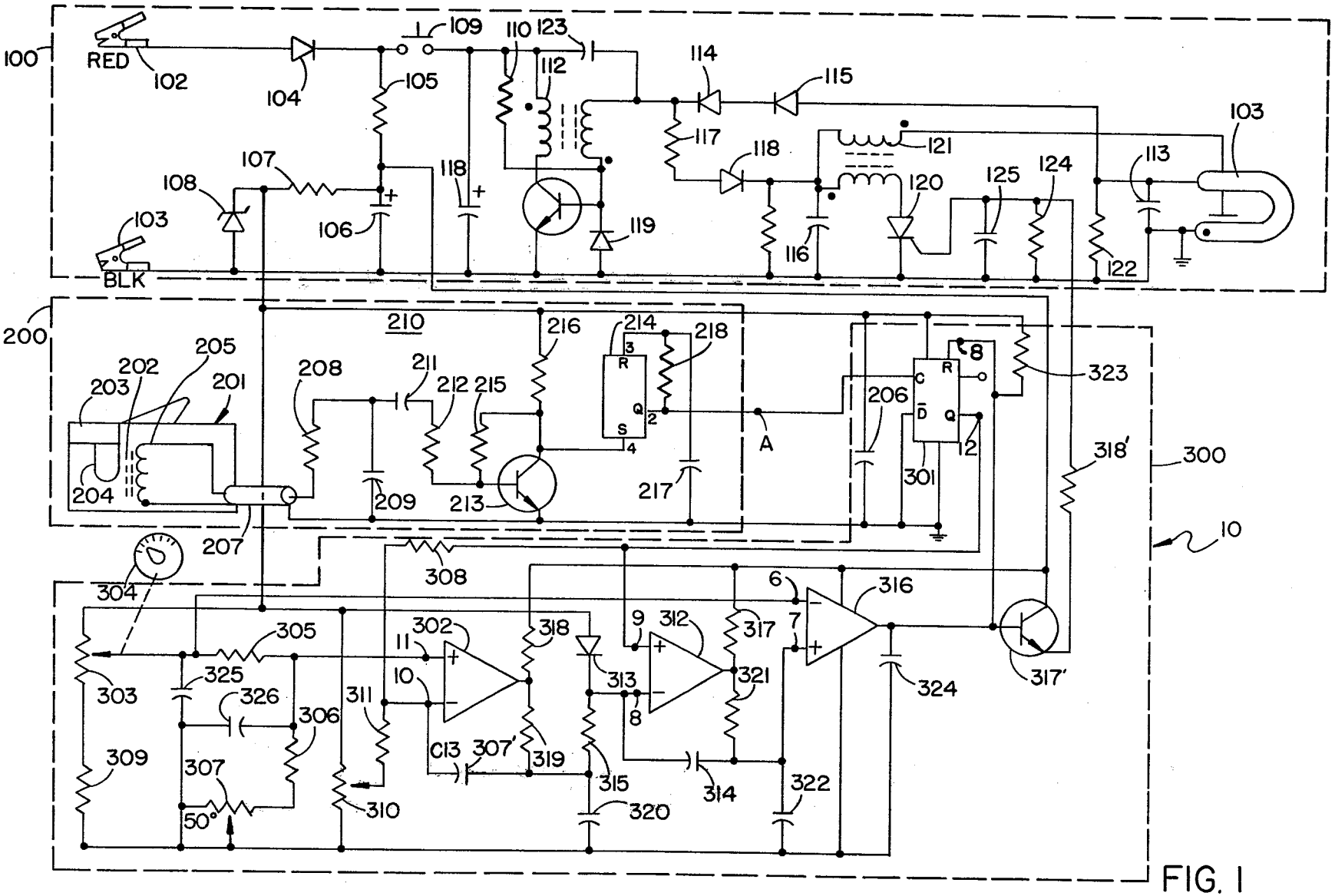
FIG. 1 is a schematic drawing of a timing advance tester in accordance with an embodiment of this invention.

Referring to FIG. 1, a timing advance tester 10 measures vacuum and centrifugal advance on internal combustion engines and includes a power drive circuit 100 which has input connections 101 and 102 for supplying power from a car battery to a strobe light 103. A spark detector circuit 200 (FIGS. 1 and 3) has an input clip 201 inductively coupled to a sparkplug for detecting a firing current and an output connected to a strobe delay generation circuit 300 for establishing a time delay between firing of the sparkplug and firing of strobe light 103. Thus the strobe delay generation circuit applies a control signal to the power drive circuit 100 to control its actuation of strobe light 103.

Spark detector circuit 200 includes components which provide excellent noise immunity thereby limiting erroneous triggering of timing advance tester 10 in response to signals other than ignition firing. Similarly, strobe delay generation circuit 300 also includes improved noise immunity features. The strobe firing delay is generated by forming a ramp voltage which increases in magnitude after initiation by spark detector circuitry 200. When the ramp voltage has reached a predetermined level, a signal from strobe delay generation circuit 300 is applied to power drive circuit 100 to fire strobe light 103. If the level of the ramp voltage is set at a very low level, such as for very small degrees of advance, relatively small noise amplitudes could cause inadvertent and undesirable triggering of the circuit. However, this circuit includes a diode offset biasing of the ramp voltage so that the ramp voltage begins its rise at a voltage above 0 and the absolute level of the ramp voltalge is higher than the amount of increase of the ramp voltage from the beginning of the ramp.

When the sparkplug fires, the spark current is sensed by input clip or clamp 201 which sends a pulse to strobe delay generation circuitry 300. Normally, the timing flash occurs as soon as the sparkplug fires, but if the flash is delayed an appropriate length of time, it occurs at the reference timing mark when there is coincidence of the stationary and the rotating timing mark. That is, by knowing the delay required to put the flash at the reference timing mark, the advance angle can be measured. The strobe delay generation circuitry 300 provides a time delay between sparkplug firing and the flashing of strobe light 103 that is equal to the time it takes for an engine to turn through a given angle of rotation. The duty cycle of the delay signal is the same as the engine angle by a feedback circuit in the strobe delay generation circuitry 300.

SPARK DETECTOR CIRCUITRY

Input clip 201 is a clamp-on inductive probe which includes a ferrite material 202 which acts as the core of a current transformer. Clip 201 includes a moveable section, 203 which provides an access opening 204 for receiving and surrounding the sparkplug wire. The sparkplug wire is the primary winding and the turns 205 of a wire around the ferrite form the secondary winding. Probe input clip 201 is connected by a coaxial cable 207 to the remainder of spark detector circuitry 200. A resistor 208 and a capacitor 209 filter the current pulse from the probe 201 into a voltage suitable for driving a probe amplifier 210. Amplifier 210 includes the series input combination of a capacitor 211 and a resistor 212 applied to the base of a transistor 213 which amplifies the voltage pulse from probe 201 to a suitable level for a logic circuit 214 which provides a noise blank impulse. A resistor 215 coupled between the base and collector of transistor 213 provides a base drive to transistor 213 by bleeding off some of the collector load current from a resistor 216 coupled between the collector and a voltage source from power drive circuitry 100. This forces the collector voltage to stay slightly above the base voltage of transistor 213 which keeps the transistor out of saturation. A probe pulse signal will be amplified by about 21 times and inverted as it passes through transistor 213.

The input filter included in spark detector circuitry 200 includes inductor 205, resistor 208 and capacitor 209 which passes a limited pulse from the leading edge of the ignition spark current. Response of this input filter to a step current is roughly a damped sinusoid with one cycle. The period is determined by inductor 205, capacitor 209 and the damping by resistor 208. Advantageously, the core loss is held to less than 20 percent of the damping effect.

For example, a pulse coupled through capacitor 211 increases current through resistor 212 which lowers the base voltage to transistor 213. As the base voltage reduces, the transistor begins turning off and the collector voltage rises. The collector voltage rises until it reaches the point when current through resistor 215 to resistor 212 keeps the base voltage nearly the same. If a probe pulse of 0.15 volts is coupled through capacitor 211 then the collector of transistor 213 must rise 3.15 volts. The collector of transistor 213 is normally held at about 0.65 volts, the drop between the collector and emitter of transistor 213, and therefore, the pulse output is 3.15 volts plus 0.65 volts or 3.80 volts.

Thus it is seen that the DC bias level is set by resistors 215 and 216 so that the quiescent output applied to circuit 214 is generally less than one volt and only negative input pulses can produce a positive output pulse. Amplifier 213 has high frequency cutoff determined primarily by resistor 215 and the collector to base capacitance of transistor 213, which helps to limit noise interference. The gain of amplifier 210 is primarily determined by the ratio of resistor 215 to resistor 212. The use of a CMOS logic circuit 214 as the threshold detector of the output of transistor 213 sets the trigger level of the amplifier 210 output at one half of the voltage supplied to amplifier 210 from power drive circuitry 100.

Logic ciruit 214 has a CMOS flip-flop which can be, for example, one half of a known integrated circuit such as a RCA Corporation type CD 4013. Circuit 214 switches when it receives an input signal with a magnitude near 50 percent of the supply voltage. When the set terminal of circuit 214, pin 4, is pulsed by the output of amplifier 210, the circuit 214 sets the "Q" output, from pin 2, goes to the supply voltage, or 6.2 volts in this case. As long as circuit 214 stays set, any further pulses at the set terminal have no further effect. The output of circuit 214 from pin 2 starts charging a capacitor 217 through a resistor 218. About two milliseconds after output 2 of circuit 214 goes positive, the voltage on capacitor 217 reaches 3.1 volts which resets circuit 214 by application of this voltage to pin 3. In summary, the pulses from pin 2 of circuit 214 which are applied to output terminal A of circuit 200 actuate the strobe delay generation circuitry 300 and block any further signals for two milliseconds.

Thus, the spark detector circuit provides a highly noise immune circuit which provides output pulses at terminal A of circuit 200 which have a frequency directly related to the engine RPM as a result of the detection of ignition firing. The average DC value of the output signal at terminal A therefore can be used for a variety of purposes in addition to that of the strobe light environment of the preferred embodiment herein. Thus, for example, the spark detecting circuit 200 can be employed for driving a tachometer display by coupling terminal A to a volt meter calibrated in RPM's such that the average voltage from terminal A (which is directly related to the engine speed) provides the input signal for such a tachometer. In the preferred embodiment, however, the spark detection circuit 200 is employed for actuating the strobe delay generation circuit as now described.

STROBE DELAY GENERATION CIRCUITRY

Strobe delay generation circuitry 300 processes the output signals from spark detector circuitry 200 so that a drive pulse for strobe light 103 is generated after an appropriate time, representing a given angle of rotation within the engine. The output a of spark detector circuitry 200 is processed so that a ramp voltage begins to build at a given rate as determined by engine rpm to a given value as determined by the amount of desired degrees of advance. When the ramp voltage reaches the predetermined level, an output from strobe delay generation circuitry 300 is applied to power drive circuitry 100 to fire strobe light 103.

The output of spark detector circuitry 200 is applied to a logic circuit 301 which can be, for example, the other half of the integrated circuit which is used for logic circuit 214. Thus, circuit 301 can be a CMOS flip-flop which is triggered into the set condition by the leading edge of the pulse from circuit 214. Flip-flop circuit 301 responds only to the positive going edge of the two millisecond pulse and thus may be reset before the two millisecond pulse ends. The output of circuit 301 from terminal 12 is a delay signal. At the end of the delay, a reset pulse appears at terminal 8 of circuit 301 to reset circuit 301. While the flip-flop circuit 301 is set, the delay signal at output 12 of circuit 301 is at 6.2 volts, or the supply voltage. This is the signal used for duty cycle control and ramp generating. A capacitor 206 is coupled across the power supply to bypass high frequency signals.

A comparator circuit 302 operates as a differential amplifier and has one input coupled to the output of circuit 301 at a terminal 10 and another input, at a terminal 11, coupled to a variable resistance 303 which is coupled to a calibrated advance dial 304. The signal output of circuit 302 generates the slope of the ramp voltage. Circuit 302 compares the duty cycle of the delay signal from circuit 301 with the voltage at terminal 11 which is a voltage set by the turning of calibrated advance dial 304 to a desired degrees of advance. For example, the duty cycle of the delay signal is 0.833 (60/720) at 60° advance which gives the delay signal an average voltage of 0.0517 volts. When the advance dial 304 is set to 60°, the voltage at resistor 303 is 6 volts. Resistors 305, 306 and 307 divide this voltage down to 0.517 volts. Resistor 307 is adjusted for calibration of the divider. A capacitor 307' is connected between the output of circuit 302 and input terminal 10, which receives the output signal from circuit 301. The output of circuit 302 drives the voltage across capacitor 307' to keep the voltage across input terminals 10 and 11 of circuit 302 equal. For example, if the input at terminal 11 is set at 0.31 volts corresponding to 36° of advance or 5 percent duty cycle, the delay signal goes to 6.2 volts for 5 percent of the time and then the delay signal goes to 0 volts for 95 percent of the time. As long as the voltage across resistor 308 is an average 0, the average current flowing in capacitor 307' is 0 and the average ramp control voltage does not change. There is a small change in the voltage during each cycle because the current through resistor 308 causes some current to flow through capacitor 307', but because the time constant of resistor 308 and capacitor 307' is large, such as 0.04 second, the change is small.

If the duty cycle of the delayed signal is larger than 5 percent the average current flows through resistor 308 toward circuit 302 discharging capacitor 307' and lowering the output voltage of circuit 302. When the ramp control voltage output of circuit 302 drops, the ramp speeds up to reduce the duty cycle. The action of circuit 302 and feedback capacitor 307' will continue to lower the output ramp control voltage until the duty cycle has been lowered to 5 percent. Conversely, if the duty cycle were too small, the ramp rate control voltage would rise to slow the ramp.

Referring to the particular operation of resistor 303 associated with calibrated dial 304, the delay system has a live 0 meaning that the voltage output of resistor 303 is not 0 volts when 0 degrees of advance are set on calibrated dial 304. There is always some voltage drop across a resistor 309 connected in series with resistor 303. The combination of resistor 309 and the portion of resistor 303 between the movable slide of resistor 303 and ground provide the live 0. To calibrate the live 0, a voltage is added to the delay signal applied to input terminal 10 so that both input terminals 10 and 11 of circuit 302 have equal applied voltage at 0 degrees advance. In particular, resistor 310 is an adjustable voltage divider that sets the 0 voltage upon circuit 302 at terminal 10 through the voltage divider formed by resistors 311 and 308.

When the advance setting is at or somewhat below 0, the duty cycle feedback (capacitor 307' in combination with circuit 302) forces the ramp to rise as fast as it can in order to lower the duty cycle. But since the duty cycle cannot be lower than 0, the delay system of timing advance tester 10 gives the least possible delay. At this setting, the tester is used essentially as a timing lamp. However, there is a minimum delay in the tester, which delay is the time it takes for a pulse from the clamp on probe 201 to trigger flash tube 103 when the advance setting is 0 degrees. Typically, the delay is 25 microseconds. This results in a minimum advance angle that is proportional to speed. For example, at 6,000 rpm the minimum advance is typically one degree.

A comparator amplifier 312 has one input terminal, pin 9, coupled to the output of circuit 301 and another input terminal, pin 8, coupled to both the output of circuit 302 and to the supply voltage through a diode 313. Before a delay cycle begins, the ramp output of circuit 312 is held at ground by the delay signal because diode 313 holds the inverting input, pin 8, of circuit 312 more positive than pin 9. When the delay signal goes to 6.2 volts, the output voltage increases, to bring pin 8 of circuit 312 up to 6.2 volts. Then circuit 312 holds the voltage at pin 8 to 6.2 volts by steadily raising the output voltage of circuit 312 to keep a constant discharge current flowing through capacitor 314 and resistance 315. This increase in voltage forms a ramp which rises at a rate depending upon the ramp control voltage output of circuit 302. If for example the ramp control voltage is 2.9 volts, resistance 315 has to have 3.3 volts (ER) across it to have 6.2 volts at pin 8 of circuit 312. The discharge current has to be 0.1 milliamps to have 3.3 volts across resistance 315. Using the formulation of volts divided by time equal to amperes divided by capacitance, the ramp speed is 0.1 milliamps divided by 0.22 microfarads or 4.5 volts per millisecond. If the ramp control voltage is raised to 5.87 volts, the current drops and the ramp slows to 0.45 volts per millisecond. Thus the magnitude of the ramp control voltage affects the rate of increase of the magnitude of the voltage ramp.

Figure 2:
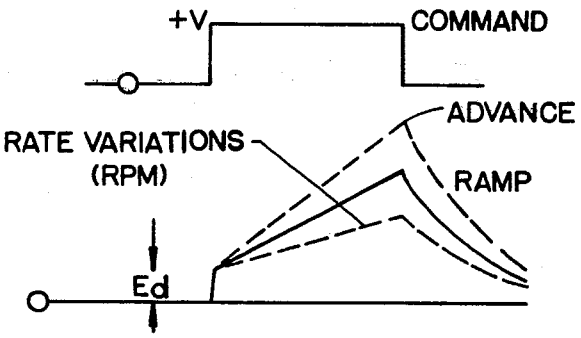
FIG. 2 is a voltage wave form diagram of the command signal and a ramp voltage signal including an initial voltage offset of Ed due to a clamping diode.
Figure 3:
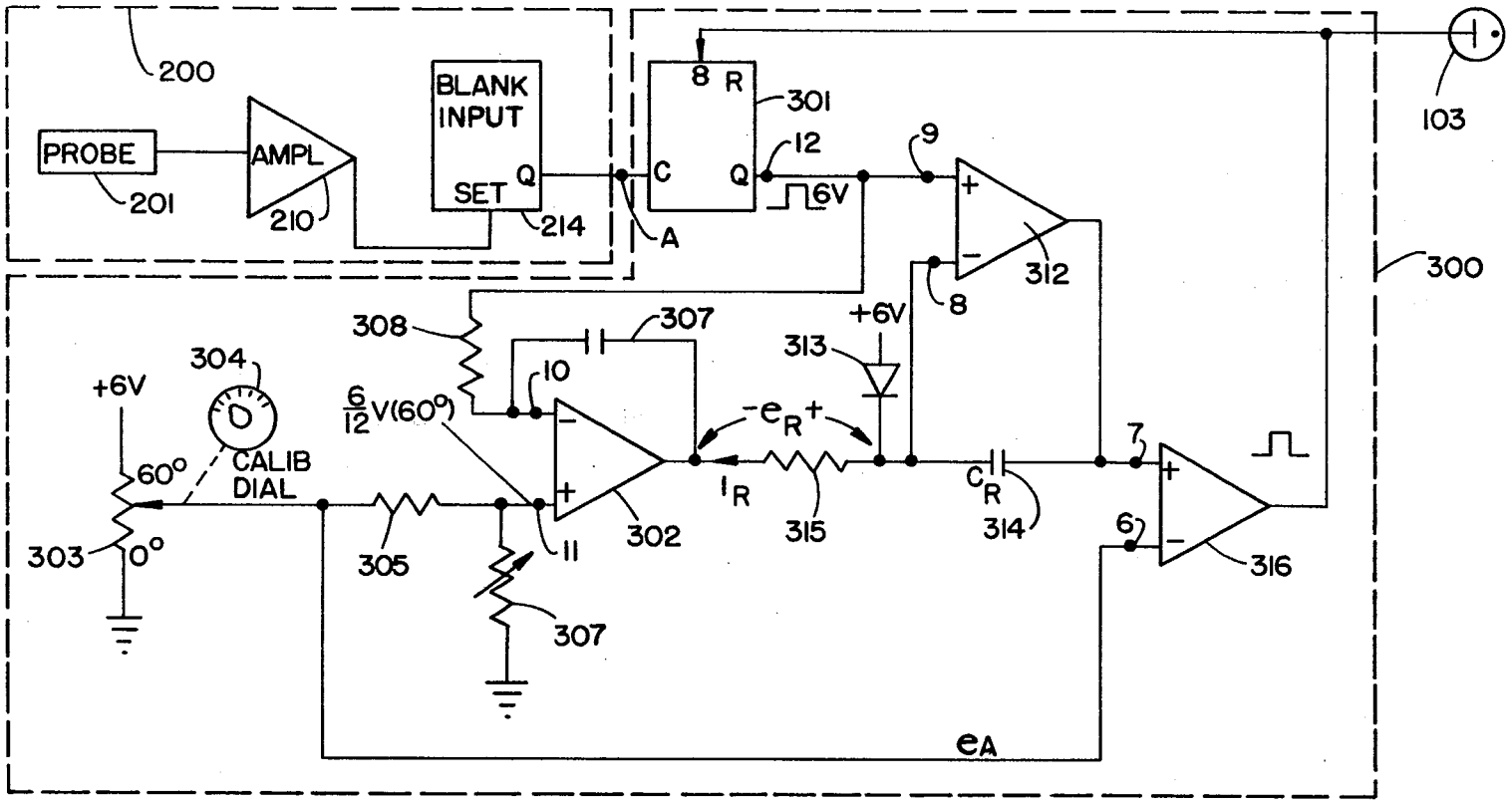
FIG. 3 is a simplified diagram in block and schematic form of the spark detection circuitry, the ramp voltage generation circuitry and the strobe lamp shown in greater detail in FIG. 1.

The command signal applied to circuit 312 at pin 9 from the output of circuit 301 allows the ramp output of 312 to be turned on and off. In particular, it is well suited to be driven by the output of a CMOS gate which swings from a plus voltage to ground. Referring to FIGS. 2 and 3, diode 313 clamps the minimum input so that capacitor 314 can rapidly discharge to a voltage state which is the supply voltage minus the voltage drop across diode 313 or $E_d$. When the voltage applied to pin 9 steps to the +V level the amplifier output jumps by $E_d$ and then begins to ramp linearly as the current (determined voltage drop across resistor 315 divided by its resistance) charges capacitor 314 at a constant rate. Diode 313 shuts off and does not interfere with the ramp. A particular advantage of the circuit is that the voltage $E_d$ provides about ⅓ of a volt extra noise margin for the comparator 316 (described later) that is triggered by the amplitude of the ramp voltage. Without the voltage $E_d$ the circuit would be much more susceptible to triggering from radio noise and conducted noises.

A comparator 316 has two inputs which are compared with pin 6 connected to the output of resistance 303 and the other input at pin 7 being connected through the output of circuit 312. The output of circuit 316 is coupled to the base of the transistor 317' which has an emitter coupled through a resistance 18 to power drive circuitry 100. When the ramp voltage (the output of circuit 312) is equal to the voltage setting of resistance 303 (i.e. Vc), the comparator output of circuit 316 at pin 1 rises to about 3.1 volts. This voltage actuates the trigger circuit 100 to fire flash tube 103 and also resets circuit 301.

When circuit 301 resets, the delay signal goes to 0 volts pulling output of circuit 312 (the ramp output voltage), down to 0 volts which recharges capacitor 314 through diode 313. As the ramp voltage goes below Vc, the output of comparator circuit 316 returns to 0 volts. Strobe delay generation circuitry 300 is now ready for another pulse. As an example, if an engine is running at 7,500 rpm with 45° of advance, at 7,500 rpm it takes one millisecond for the engine to turn 45°. A ramp control voltage of 2.9 volts sets the ramp speed at 4.5 volts per millisecond. When Vc is set to 4.5 volts, the timing mark is aligned because the flash is delayed one millisecond and the engine has turned 45° to top dead center in one millisecond.

Comparator circuits 302, 312, and 316 are differential comparators which have a common emitter transistor output. To obtain amplification, they require pull-up resistors 317 and 318. The differential comparators operate in a switching mode such that the outputs go full on or full off. The outputs are filtered to give a smooth analog signal by resistors 319 and capacitor 320 for circuit 302 and resistor 321 and capacitor 322 for circuit 312. Comparator 316 is used as a normal comparator; its output either turns on or off depending on the input signals. Resistor 323 is a pullup resistor that provides the voltage pulse to reset circuit 301 when comparator 316 turns off, that is when the two inputs to comparator 316 are equal. A capacitor 324 slows the rise of the voltage at the output of circuit 316 to make certain that the pulse at the output is long enough to drive SCR 120.

POWER DRIVE CIRCUITRY

Timing advance tester 10 is powered by an automobile battery which is connected by means of clamps 102 and 103. A diode 104 connected to clamp protects the circuit against reverse polarity hookup. Resistor 105 and capacitor 106 provide an RC filtered supply of about +13 volts to power circuits 302, 312, and 316. The +13 volt power for circuit 312 allows full comparator operation on the ramp volage from 0 through 6.2 volts because the voltage supply to circuit 312 must be at least 1 ½ volts about the input to operate. A resistor 107 and a regulator diode 108 provide a stable 6.2 volt supply for strobe delay generation circuitry 300. On/off switch 109 completes connection of the battery power source to power drive circuitry 100 so that timing advance tester 10 only flashes when switch 109 is closed.

When the voltage from the auto battery or, about 14 volts, is applied to the remainder of power drive circuitry 100 with switch 109 closed, current flows through a resistor 110 and the base of a transistor 111 turning transistor 111 on. When transistor 111 turns on, the primary of a transformer 112 has 14 volts across it which is multiplied by the turns ratio to 500 volts at the secondary. The secondary voltage begins charging capacitor 113 through diode 114 and diode 115. The charging current flows through the secondary of transformer 112 to the base of transistor 111 keeping it turned on. The secondary current causes a primary current to flow through transistor 111 from the collector to the emitter. When the secondary current drops to a point where the gain of the transistor 111 times the secondary currrent is less than the primary current, transistor 111 turns off. When transistor 111 turns off, the inductance of transformer 112 reverses the voltage at the primary attempting to maintain the current in the primary of transformer 112. The primary voltage reversal causes the magnetizing current to decay in the secondary of transformer 112 by charging capacitor 116 through resistor 117 and diode 118. The current in the secondary of transformer 112 flows through diode 119 keeping transistor 111 turned off, until it is less than the current through resistor 110, at which time transistor 111 turns on and the cycle repeats. The current in the secondary charges capacitor 116 to 150 volts which is set by a voltage divider made up of resistors 117 and 118. Capacitor 116 is the power supply for a trigger circuit, described below, for generating a voltage to fire flash tube 103.

The pulse from comparator 316 drives transistor 317 as an emitter-follower and its current flows through resistor 318' and the gate of a silicon controlled rectifier 120 turning rectifier 120 on. Rectifier 120 applies 150 volts from capacitor 116 across the primary winding of a transformer 121. The secondary winding steps this voltage up to about 4 kilovolts which ionizes the gas in flash tube 103. The voltage on capacitor 116 is quickly discharged through transformer 121, building up a current in the primary of transformer 121. The inductance of transformer 121 keeps the primary current flowing long enough to charge capacitor 116 to a negative voltage that turns rectifier 120 off when the primary current stops.

Capacitor 118 provides transient protection for transistor 111 and transformer 112. A capacitor 123 loads transformer 112 and transistor 111 to reduce the effects of load changes on magnetizing current; resistor 124 and capacitor 125 provide noise filtering and leakage control at the gate of rectifier 120. Resistor 122 is a bleed resistor for a capacitor 113. Flash tube 103 is typically a xenon flash tube which discharges with a bright blue white flash used to momentarily illuminate the engines timing marks. Capacitors 325 and 326 in strobe delay generation circuitry 300 provide noise suppression.

The speed range of timing advance tester 10 as described above is limited by the circuit design to about 10,000 rpm on the high end. Above 10,000 rpm, the tester may not give accurate readings. There may be an error over one degree when the speed is below 500 rpm's.

Spark detector circuitry 200 is designed to respond to a sparkplug current of 60 milliamps or more. Advance testing can be done on two cycle engines by dividing the advance reading by two. The tester is calibrated in crankshaft degrees, which is different from distributor testers that measure distributor degrees. Advance specifications may be given either way, so to get advance in distributor degrees, divide the reading on the calibrated dial by 2. Advance is read from the dial scale when the knob has been adjusted to stroboscopically align the rotating timing mark with the engine reference mark. The reading is accurate to within plus and minus 2 degrees of advance from 500 to 6,000 rpm, and is primarily limited by the linearity of potentiometers 303.

Various modifications and variations will no doubt occur to those skilled in the various arts to which this invention pertains. Such variations which basically rely on the teachings through which this disclosure has advanced the art are properly considered within the scope of this invention as defined by the appended claims.

The embodiment of the invention in which an exclusive property or privilege is claimed are defined as follows.

1. A control circuit for a strobe lamp used for timing an engine comprising:

means for generating a pulse signal indicating the occurence of ignitin firing;

pulse amplifier means coupled to said generating means, said pulse amplifier means including means for providing a quiescent output voltage level below a predetermined threshold and a signal output level significantly above said threshold level;

logic circuit means coupled to said pulse amplifier means and responsive to signals above said threshold level to provide a control output signal;

delay circuit means coupled to said logic circuit means for selectively delaying said control output signal; and a lamp firing circuit coupled to said delay circuit means and responsive to the delayed control output signal for firing a timing lamp.

2. The circuit as defined in claim 1 wherein said pulse amplifier means comprises an input filter coupled to said generating means and a solid state amplifier coupled to said input filter and wherein said means for providing a quiescent output voltage comprises biasing means for said solid state amplifier.

3. The system as defined in claim 2 wherein said input filter includes resistive and capacitive circuit elements selected and coupled to provide a damped sinusoid output signal applied to said solid state amplifier.

4. The circuit as defined in claim 3 wherein said solid state amplifier comprises a transistor having a base terminal coupled to said input filer and said biasing means comprises a resistive voltage divider coupled between said base terminal to a collector terminal and from said collector terminal to a source of operating potential.

5. The circuit as defined in claim 1 wherein said delay circuit means includes a ramp voltage driver circuit including a diode clamp to provide a ramp voltage output which is offset by the voltage drop across said diode to provide noise immunity from noise signals whose amplitude is less than the diode voltage drop.

6. A control circuit for a strobe lamp used for timing an engine comprising:

means for generating a pulse signal indicating the occurrence of ignition firing;

pulse amplifier means coupled to said generating means;

delay circuit means coupled to said generating means for selectivelay delaying said control output signal wherein said delay circuit means includes a ramp voltage driver circuit including a diode clamp to provide a ramp voltage output which is offset by the voltage drop across said diode to provide noise immunity from noise signals whose amplitude is less than the diode voltage drop; and a lamp firing circuit coupled to said delay circuit means and responsive to the delayed control output signal for firing a timing lamp.

7. A timing control circuit for a strobe lamp used in the timing adjustment comprising:

spark detector means for generating a signal indicating the occurrence of ignition firing, said spark detector means including an inductor for inductively coupling said detector means to an ignition wire, a capacitor coupled in parallel to said inductor, a transistor having a base and an emitter coupled across said capacitor, a collector adapted to be coupled to a voltage source through a first resistor, and a second resistor coupled between the collector and the base of said transistor wherein ignition firing as a result of a rapidly increased electric ignition current causes an induced current in said inductance which resonates with said capacitance and applies a signal to the base of said transistor which tends to turn off said transistor thereby causing the collector voltage of said transistor to rise;

reference voltage means for producing a pulse delay signal having a plurality of spaced, generally square pulses, said reference voltage means including means for varying the width of said pulse as a function of a desired amount of deviation of strobe lamp flash from the occurrence of ignition firing and for varying the duty cycle of said pulse delay signal, so that said pulse delay signal has a pulse length proportional to the amount of deviation of strobe lamp flash from the occurence of the ignition firing and the pulse repetition rate is proportional to the occurence of successive engine adjustment points; and delay means coupled to said spark detector means and said reference voltage means for producing an increasing ramp voltage synchronized with ignition firing so that the duration of said ramp voltage and the duration of time between sequential ramp voltages produced as a result of sequential ignition firings is a function of said pulse delay signal.

8. A timing control circuit as recited in claim 7 wherein said delay means includes:

a ramp control means for defining the slope of the ramp voltage as a function of the repetition rate of engine adjustment reference points;

a ramp voltage means for increasing the ramp voltage at a rate set by said ramp control means; and comparison means having a first input coupled to said ramp voltage means, a second input coupled to said reference voltage means, and an output coupled to the strobe lamp for generating an output signal for activating the strobe lamp when the ramp voltage reaches a predetermined reference voltage.

9. A timing control circuit as defined in claim 7 including:

a calibrated ignition advance adjustment means for setting the desired deviation of the ignition firing from the engine adjustment reference point; and means for connecting said reference voltage means to said ignition advance adjustment means.

10. A timing control circuit as defined in claim 8 wherein said ramp control means includes a first differential comparator having a first input coupled to an output of said spark detector means, a second input coupled to said reference voltage and a feed back capacitor coupled between an output of said first differential comparator and said first input so that the voltage across said capacitor is proportional to the duty cycle of a signal applied to said first input.

11. A timing control circuit is defined in claim 10 wherein said ramp voltage means includes a second differential comparator having an input coupled to an output of said first differential comparator, for discerning the slope of the ramp voltage, another input coupled to said output of said spark detector means for activating and deactivating generation of the ramp voltage, an output and a second capacitor coupled between said another input and said output for passing a discharge current to provide an increasing ramp voltage at the output.

12. A timing control circuit as defined in claim 11 wherein said comparator means includes a third differential comparator having an input coupled to the reference voltage, another input coupled to the output of said second differential comparator and an output providing a pulse for firing the strobe lamp.

13. A timing control circuit as defined in claim 12 wherein said reference voltage means includes a manually adjusted potentiometer calibrated in degrees to provide an indicatin of the amount of ignition firing advance.

14. A timing control circuit as defined in claim 13 wherein said spark detector means includes a multivibrator coupled between the collector of said transistor and said delay means for producing a pulse in response to an ignition firing.

15. A spark current detector for generating a signal indicating the occurence of ignition firing said spark detector including:

a damped tuned circuit inductively coupled to an ignition wire for producing a damped sinusoidal signal in response to the occurence of ignition current;

a transistor having base emitter and collector terminals, the base and emitter terminals being coupled to said tuned circuit and said collector adapted to be coupled to a voltage source, said transistor selected to have an inherent base and collector feedback capacitance for reducing noise amplification;

a series combination of a first resistor and a capacitor coupled between said tuned circuit and the base terminal of said transistor, a second resistor coupled between the base and the collector of said transistor for biasing said transistor; and logic circuit means coupled to said collector terminal for producing a pulse output in response to an output pulse at the collector terminal of said transistor, said logic means including an input terminal coupled to the collector terminal of said transistor wherein said spark current detector is substantially immune to noise due to the relatively high impedence between said tuned circuit and the base terminal of said transistor, and wherein the output level of said transistor in response to an input is controllable by varying the values of said 1st and 2nd resistors coupled to said transistor, and undesired noise is reduced by selecting said capacitances to shunt high frequency noise signals to ground, reducing amplification of noise by collector-base capacitance feedback, and selecting a trigger level for said logic circuit means substantially exceeding the magnitude of the maximum signal needed to alter the conducting or non-conducting condition of said transistor.

16. A timing control circuit for a strobe lamp for use in the timing adjustment of an internal combustion engine comprising:

a calibrated ignition advance adjustment means for setting the desired deviation of the ignition firing from the engine adjustment reference point, said advance adjustment means including a variable potentiometer coupled to a voltage source and being adjustable to a minimum resistance so that when the advance adjustment means is set to zero degrees of advance, the adjustable voltage across said potentiometer is greater than zero volts and said advance adjustment means can be mechanically adjusted to an electrical threshold associated with zero degrees advance;

ramp control means for generating a signal to determine the slope of a voltage signal used to determine the deviation of ignition firing and the occurrence of the engine adjustment point, said ramp control means having an input coupled to said ignition advance adjustment means;

ramp voltage means for increasing the ramp voltage at a rate set by said ramp control means, said ramp voltage means having a first input adapted to receive a pulse indicating ignition firing and a second input coupled through a diode to a voltage source and coupled to the output of said ramp control means, an output, and a capacitor coupled between said output and said second input, so that actuation of an increasing ramp voltage occurs during the duration of the pulse indicating occurrence of ignition firing, said diode conductive before ramp voltage actuation and;

non-conductive during the period of ramp voltage actuation, and being in transition of turning off at the beginning of the period of ramp voltage actuation to offset the ramp voltage an aount approximately equal to the voltage drop across said diode so that a circuit component triggered by the maximum height of the ramp voltage is not falsely triggered by noise with a magnitude less than said voltage drop even when the maximum height of the ramp voltage is substantially equal to said voltage drop and the increase in the ramp voltage during the period of ramp voltage actuation is substantially zero.

17. A timing control circuit for a strobe lamp for use in the timing adjustment of an internal combustion engine comprising:

power drive circuitry means for connecting to an automobile battery including an input for receiving electrical power from the auto battery and an output including a strobe lamp and conrol means for coupling the input to the output;

spark detector circuitry for generating a signal indicating the occurence of ignition firing, said spark detector means including an inductor for inductively coupling said spark detector to an ignition wire, a capacitor coupled in series with said inductor, a transistor having a base and an emitter coupled across said capacitor;

an input capacitor and an input resistor coupled in series between said capacitor and the base, a feedback resistor coupled between the collector and the base of the transistor and a collector resistor coupled between a collector of said transistor and a voltage source;

a first logic circuit means including an input coupled to the collector of said transistor so that said transistor is normally on and the occurence of a pulse from an ignition pulse or current causes a current through the input capacitor and input resistor to lower the base voltage thereby causing a current to flow and the feedback resistor between the collector and the base of said transistor thereby reaching a stable state for the base voltage, said transistor having a collector-to-base capacitance sufficiently large to attenuate noise interference, and said first logic means producing an output pulse in response to said ignition pulse;

a strobe delay generation circuitry means for delaying the firing of the strobe lamp a desired deviation after the beginning of the ignition pulse output from said first logic means, said delay generation circuitry means including a second logic means for producing a delay signal, wherein said second logic means is coupled to said first logic means and has an output; a calibrated dial coupled to a variable potentiometer for establishing a voltage level representing the desired amount of advance degrees, a voltage ramp control means for generating the slope of a ramp voltage for use in determining the desired delay having a first input coupled to the output of said second logic means and a second input coupled to the output of said calibrated dial so that the output of the control means has the same duty cycle as both of the inputs;

said strobe delay generation circuitry means further including a second comparator means having a first input coupled to the output of said second logic means and a second input coupled to the output of said first comparator and coupled to a voltage source through a diode so that the output of said second comparator is a ramp voltage which has an initial offset equal to the voltage up across said diode and increases at the slope determined by said first comparator; and said strobe delay generation circuit means further including a third comparator having a first input coupled to the output of said second comparator and a second input coupled to the output of said calibrated dial and having an output when said first and second inputs have an equal magnitude thereby producing a pulse for firing the strobe lamp and for resetting said second logic means.

18. An electrical circuit used for developing a signal from an engine ignition comprising:

means for generating a pulse signal indicating the occurence of ignition firing;

pulse amplifier means coupled to said generating means, said pulse amplifier means including means for providing a quiescent output voltage level below a predetermined threshold and a signal output level significantly above said threshold level; and logic circuit means coupled to said pulse amplifier means and responsive to signals above said threshold level to provide an output signal representative of the frequency of firing of the engine.

19. The circuit as defined in claim 18 wherein said pulse amplifier means comprises an input filter coupled to said generating means and a solid state amplifier coupled to said input filter and wherein said means for providing a quiescent output voltage comprises biasing means for said solid state amplifier.

20. The system as defined in claim 19 wherein said input filter includes resistive and capacitive circuit elements selected and coupled to provide a damped sinusoid output signal applied to said solid state amplifier.

21. The circuit as defined in claim 20 including a source of operating potential and wherein said solid state amplifier comprises a transistor having a base terminal coupled to said input filter and said biasing means comprises a resistive voltage divider coupled between said base terminal to a collector terminal and from said collector terminal to said source of operating potential.

* * * * *

UNITED STATES PATENT AND TRADEMARK OFFICE

CERTIFICATE OF CORRECTION

PATENT NO. : 4,146,833

DATED : March 27, 1979

INVENTOR(S) : McKinnon et al.

It is certified that error appears in the above-identified patent and that said Letters Patent are hereby corrected as shown below:

Column 1, line 13:

after "combustion" insert --- engine ---;

Column 8, line 5:

after "clamp" insert --- 102 ---;

Column 9, line 27:

"potentiometers" should be --- potentiometer ---;

Column 9, line 34:

"embodiment" should be --- embodiments ---;

Column 9, line 40:

"ignitin" should be --- ignition ---;

Column 9, line 67:

"filer" should be --- filter ---;

Column 10, line 16:

"selectivelay" should be --- selectively ---;

UNITED STATES PATENT AND TRADEMARK OFFICE

CERTIFICATE OF CORRECTION

PATENT NO. : 4,146,833

DATED : March 27, 1979

INVENTOR(S) : McKinnon et al.

It is certified that error appears in the above-identified patent and that said Letters Patent are hereby corrected as shown below:

Column 11, line 25:

"is" should be --- as ---;

Column 11, line 45:

"indicatin" should be --- indication ---;

Column 12, line 59:

"aount" should be --- amount ---;

Signed and Sealed this

*Seventeenth* Day of *July 1979*

[SEAL]

*Attest:*

LUTRELLE F. PARKER

*Attesting Officer* *Acting Commissioner of Patents and Trademarks*